US008277080B2

(12) United States Patent
Duffy et al.

(10) Patent No.: US 8,277,080 B2
(45) Date of Patent: Oct. 2, 2012

(54) OUTDOOR LOW POWER LED LAMP

(76) Inventors: Gerard Duffy, Saint James, NY (US); John Bonlarron, Smithtown, NY (US)

( * ) Notice: Subject to any disclaimer, the term of this patent is extended or adjusted under 35 U.S.C. 154(b) by 315 days.

(21) Appl. No.: 12/622,120

(22) Filed: Nov. 19, 2009

(65) Prior Publication Data

US 2010/0124059 A1 May 20, 2010

Related U.S. Application Data

(60) Provisional application No. 61/116,178, filed on Nov. 19, 2008.

(51) Int. Cl.
*F21V 21/00* (2006.01)

(52) U.S. Cl. ..... 362/249.02; 362/294; 362/373; 362/249.1; 362/285; 362/431

(58) Field of Classification Search ..... 362/431, 362/240, 294, 373, 249.02, 249.03, 249.07, 362/249.09, 249.1, 249.11, 285, 427
See application file for complete search history.

(56) References Cited

U.S. PATENT DOCUMENTS

| | | | | |
|---|---|---|---|---|
| 7,246,929 | B2 * | 7/2007 | Schuster | 362/431 |
| 7,608,815 | B2 * | 10/2009 | Sharma et al. | 250/238 |
| 7,771,087 | B2 * | 8/2010 | Wilcox et al. | 362/294 |
| 7,810,957 | B2 * | 10/2010 | Zeng et al. | 362/294 |
| 8,007,142 | B2 * | 8/2011 | Ku et al. | 362/368 |
| 8,021,026 | B2 * | 9/2011 | Liu et al. | 362/419 |
| 8,025,428 | B2 * | 9/2011 | Duguay et al. | 362/311.02 |
| 2009/0034257 | A1 * | 2/2009 | Liu et al. | 362/252 |
| 2009/0196038 | A1 | 8/2009 | Vargas Maciel | |

* cited by examiner

*Primary Examiner* — Ali Alavi
(74) *Attorney, Agent, or Firm* — F. Chau & Associates, LLC; Joseph B. Gross, Esq.

(57) ABSTRACT

An LED based lighting fixture for street lighting includes a lighting head unit including a heat sink structure for dissipating heat. Below the heat sink structure is one or more LED circuit boards each including a plurality of low power LEDs oriented in a plurality of different directions. Light emitted from the lighting head unit is cast in a desired pattern of disbursement. A lens unit is attached to the bottom side of the lighting head unit covering the LED circuit board. The lighting fixture includes a mounting unit for mounting the lighting head unit to a fixed structure such that an angle of the lighting head unit may be adjusted to direct the pattern of disbursement of light cast from the lighting head unit to a desired direction.

26 Claims, 6 Drawing Sheets

11

OUTDOOR LOW POWER LED LAMP

CROSS-REFERENCE TO RELATED APPLICATION

The present application is based on provisional application Ser. No. 61/116,178, filed Nov. 19, 2008, the entire contents of which are herein incorporated by reference.

BACKGROUND OF THE INVENTION

1. Technical Field

The present disclosure relates to outdoor lamps and, more specifically, to outdoor low power LED lamps.

2. Discussion of Related Art

Light emitting diodes (LEDs) are lighting elements that are based on semiconductor diodes. While LEDs have traditionally been used only to generate monochromatic light, modern configurations allow for the generation of white light either by combining red, blue and green LEDs or by the use of a phosphor material. Accordingly, LED based lighting fixtures have been developed to provide illumination.

LED based lighting fixtures may be used to produce a relatively high quality and high intensity light while drawing relatively low power. Moreover, LED based lighting fixtures may have a very long useful life span and may maintain a consistent color spectrum over a very long period of time. LED based lighting fixtures may also be free of harmful chemicals such as those commonly found in fluorescent lights. Accordingly, LED based lighting fixtures may provide a means of lighting that is both inexpensive to operate and environmentally responsible.

LED based lighting, however, tends to provide a very narrow and focused beam of light, rather than the wide disbursement of light generally found with fluorescent and incandescent lighting fixtures. This property may make LED based lighting unsuitable for providing illumination in certain circumstances. Moreover, the individual LEDs of the lighting fixture may generate heat that tends to be localized to the circuit upon which the LEDs are mounted. Excess heat may then adversely affect the performance and life span of the LED based lighting fixture.

Because of the narrow light disbursement and heat characteristics, LED based lighting has generally been impractical for applications such as municipal street lighting where it is often difficult to dissipate heat and where wide disbursement of light is desired.

SUMMARY

An LED based lighting fixture for street lighting includes a lighting head unit including a heat sink structure for dissipating heat. Below the heat sink structure is an LED circuit board including a plurality of low power LEDs oriented in a plurality of different directions relative to the orientation of the lighting head unit. Light emitted from the lighting head unit is cast in a desired pattern of disbursement. A lens unit is attached to the bottom side of the lighting head unit covering the LED circuit board. The lighting fixture includes a mounting unit for mounting the lighting head unit to a fixed structure. The mounting unit is adjustably connected to the lighting head unit such that an angle of the lighting head unit, relative to the fixed structure, may be adjusted to direct pattern of disbursement of light cast from the lighting head unit to a desired direction.

The heat sink structure may include an aluminum ribbon with a series of projections extending tangentially therefrom, wherein the aluminum ribbon comprises aluminum or an alloy thereof. The aluminum ribbon may have a head-and-shoulders shaped cross section or a plurality of petal extensions.

The LED circuit board may be ceramic and may conduct heat from the plurality of low power LEDs to the heat sink structure.

The plurality of low power LEDs may be organized as a plurality of identical clusters wherein each cluster includes LEDs oriented in a plurality of different directions relative to the orientation of the lighting head. The identical clusters may be arranged in rows and columns and may be spaced equally from one another.

The identical clusters may be arranged as seven columns and four rows, with the rows run along a longest axis of the lighting fixture. Each identical cluster may include sixteen low power LEDs oriented in a plurality of different directions relative to the orientation of the lighting head unit. The plurality of low power LEDs may together draw from between 25 Watts and 60 Watts maximum power.

The lens unit may include a single convex covering that covers the entire LED circuit board and attaches directly to the lighting head unit such that the LED circuit board is hermetically sealed and impervious to moisture.

The lighting fixture may further include a module base that is attached at one end to the lighting head unit and at another end to the mounting unit. The module base unit may house a power supply unit for supplying power to the LED circuit board. The power supply unit may be configured to accept a range of input voltages from 85 Volts to 267 Volts while providing a constant output voltage to the LED circuit board.

The heat sink structure and the lens unit may together form an approximate cylinder with a fixed radius and a radius of the module base is less than the fixed radius of the heat sink structure together with the lens unit.

The lighting fixture may further include a thermal conductive paste between the LED circuit board and the heat sink structure.

An LED based lighting fixture for street lighting includes a lighting head unit including, on a top side, a heat sink structure for dissipating heat and, on a bottom side, a plurality of LED circuit boards. Each board includes a plurality of low power LEDs oriented in a plurality of different directions relative to the orientation of the lighting head unit. Light emitted from the lighting head unit is cast in a desired pattern of disbursement. A lens unit is attached to the bottom side of the lighting head unit covering the plurality of LED circuit boards. A mounting unit mounts the lighting head unit to a fixed structure. The mounting unit is adjustably connected to the lighting head unit such that an angle of the lighting head unit, relative to the fixed structure, may be adjusted to direct pattern of disbursement of light cast from the lighting head unit to a desired direction.

The top side of the head unit and the heat sink structure attached thereto may be contoured to prevent the collection of rain water. The contour of the heat sink structure may form a wave shape with two peaks and a nadir therebetween. The nadir of the heat sink contour may open into a depression within the top side of the head unit for channeling water off of the light fixture.

The heat sink structure may include a plurality of fins for effectively dissipating heat. The lighting head unit may include aluminum for effectively conducting heat from the plurality of LED circuit boards to the heat sink structure.

A light sensing unit for sensing ambient light may be attached to the top side of the lighting head unit for activating the LED circuit boards when the detected ambient light is below a predetermined threshold and deactivating the LED circuit boards when the detected ambient light is above a predetermined threshold.

The mounting unit may include a set of interlocking teeth for maintaining the desired angle of the lighting head unit relative to the fixed structure even when significant pressure is applied to the lighting head unit.

A power supply unit supplying power to the plurality of LED circuit boards may be contained within the lighting head unit.

The mounting unit may include a remote-controlled actuator for remotely adjusting the desired angle of the lighting head unit relative to the fixed structure.

The plurality of LED boards may include two or more LED boards. For example, the plurality of LED boards may include 2, 4, 6 or 8 LED boards.

The desired pattern of disbursement of light of the lighting head unit may be shaped to illuminate a particular area while minimizing light directed to surrounding areas. The particular area may include one or more lanes of a roadway.

The lens unit may be attached to the bottom side of the lighting head unit with a piano hinge on one side and one or more non-removable thumb screws on another side such that the lens unit may be easily opened and closed without risking the loss of the screws.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE DRAWINGS

Figure 1A:
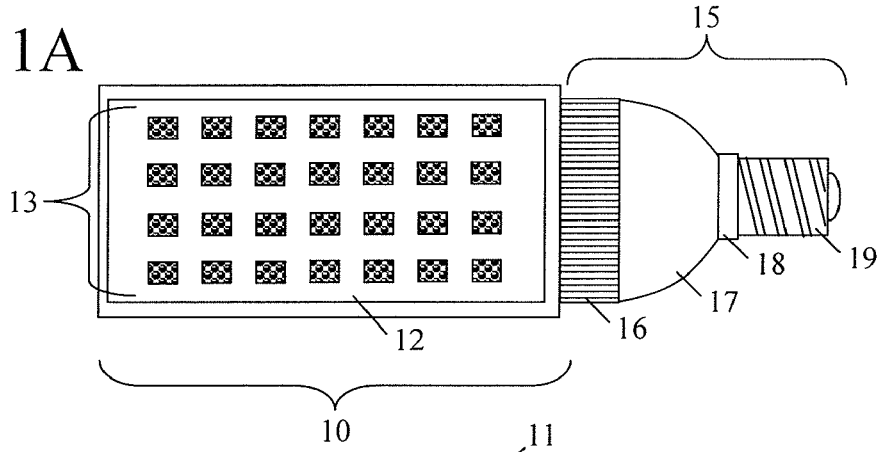
FIGS. 1A-1C are schematic diagrams illustrating an LED based lighting fixture according to an exemplary embodiment of the present invention.

In describing exemplary embodiments of the present disclosure illustrated in the drawings, specific terminology is employed for sake of clarity. However, the present disclosure is not intended to be limited to the specific terminology so selected, and it is to be understood that each specific element includes all technical equivalents which operate in a similar manner.

Exemplary embodiments of the present invention seek to provide an LED lamp that is suitable for outdoor use, for example, as a municipal street light. Such lamps may effectively dissipate heat from the LED circuits and may provide for a wide disbursement of light that is tailored to the particular needs of street lighting with minimal light being directed to areas not in need of illumination. Accordingly, exemplary embodiments of the present invention may provide optimal lighting characteristics while also being highly economical and environmentally responsible. Additionally, by limiting illumination to desired areas, light pollution, which is the flooding of artificial light into the night's sky, may be minimized thereby reducing harmful effects caused by light pollution which include enjoyment of the night sky and astronomical observation. There may also be adverse health consequences associated with light pollution.

Exemplary embodiments of the present invention may provide for an LED based lighting fixture for use as street lighting. The LED based lighting fixture may either be a bulb replacement assembly that screws into or is otherwise received by a street light or a full street lamp that attaches to a pole. Where the LED based lighting fixture is a bulb replacement, exemplary embodiments of the present invention may be used with a conventional street light that was designed for incandescent bulbs. Where the LED based lighting fixture is a full street lamp, a greater number of LEDs may be accommodated for increased illumination and versatility of design. In both cases, characteristics may be interchangeable and accordingly, characteristics described with respect to the bulb replacement embodiments may be freely applied to the full street lamp embodiments and visa versa.

Figure 1B:
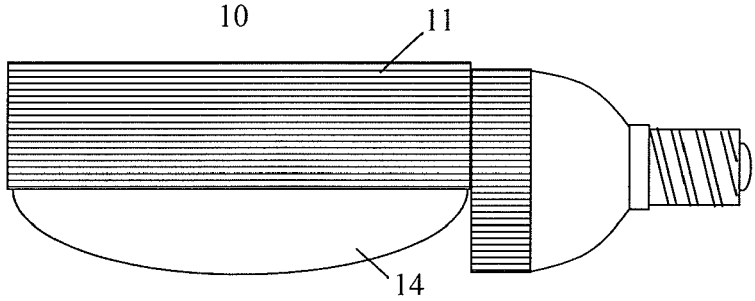
Figure 1C:
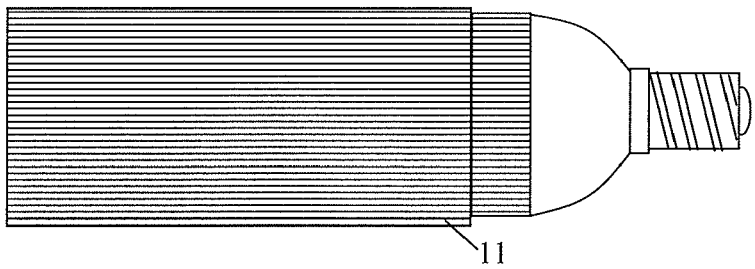

FIGS. 1A-1C are schematic diagrams illustrating an LED based lighting fixture according to an exemplary embodiment of the present invention. Each of FIGS. 1A-1C illustrate the same embodiment rotated to a different angle with FIG. 1A illustrating the lighting fixture with the illuminating elements facing out, FIG. 1B illustrating the lighting fixture with the illuminating elements facing down, and FIG. 1C illustrating the lighting fixture with the illuminating element facing in.

In this embodiment, the lighting fixture may be used as a screw-in replacement for a conventional street light or it may be used within a specially designed street light. The fixture may include a lighting head unit 10. The lighting head unit 10 may include an LED circuit board 12. The LED circuit board 12 may be made out of ceramic, PVC, plastic or another hard substance but may preferable be able to effectively conduct heat away from a plurality of LED clusters 13 that are arranged thereon. The LED clusters may each include a plurality of low power LEDs. Accordingly, the entire LED circuit board 12, when activated, may draw approximately 28 Watts.

The LED clusters 13 may be arranged, for example, in a series of rows and columns with regular spacing therebetween. The organization of the rows and columns of LED clusters 13 may be selected to help produce the desired light disbursement pattern. For example, the LED clusters may be arranged as seven columns and four rows, with the rows oriented to run along the longest axis of the lighting fixture (shown in the horizontal) and the columns oriented to run perpendicularly to the longest axis (shown in the vertical). Accordingly, there may be twenty eight discrete LED clusters 13 formed along the LED circuit board 12.

Each of the LED clusters 13 may be identical in arrangement to the other LED clusters 13 in both number of LEDs formed thereon and the orientation of the constituent LEDs. Alternatively, different LED clusters 13 may have a different number of LEDs formed thereon and/or LEDs with a different pattern of orientation.

A heat sink 11 may be formed behind the LED circuit board 12 such that the LED clusters 13 face in a direction opposite to the heat sink 11. By placing the heat sink 11 behind the LED clusters 13, heat generated by the LED clusters 13 may be conducted away from the LED circuit board 12 and dissipated by the heat sink 11.

Accordingly, the LED circuit board 12 may have a front face that is defined as the side in which the LED clusters 13 are mounted and a back face that is in contact with the heat sink 11. A thermal paste may be applied between the back face of the LED circuit board 12 and the heat sink 11 to enhance the conduction of heat away from the circuit board 12 and to the heat sink 11 where it is dissipated.

A lens 14 may be arranged to cover the front face of the LED circuit board 12. The lens 14 may be constructed of a rigid and transparent material such as a plastic or resin, for example, polycarbonate. Alternatively, the lens 14 may be translucent to diffuse light emanating from the LED clusters 13. The lens 14 may also optionally be coated with a phosphor, for example, in an embodiment of the present invention where all of the LED clusters produce ultraviolet (UV) light and the phosphor on the lens 14 converts the UV light to white light.

The lens 14 may be shaped as a semi-sphere dome or a semi-cylinder. Other lens 14 shapes may alternatively be used. The curvature of the lens 14 may be used to better direct the light emanating from the LED circuit board 12.

The shape of the heat sink is described in greater detail below, however, it should be noted that the shape of the heat sink 11 together with the lens 14 forms an approximate cylinder to more easily substitute for a conventional light fixture, where desired.

The head unit 10 of the light fixture may be connected to a base unit 15 of the light fixture. The base unit may include a heat sink ring 16, a module base 17, an angular adjustment ring 18 and a mounting unit 19. The module base 17 may house a power supply unit (PSU) (not shown) for converting alternating current (AC) into the desired direct current (DC) for powering the LED clusters 13.

Conventional street lights utilize AC and AC is easier to provide across long distances that DC. Accordingly, AC is generally supplied to street lights. LED clusters, however, generally operate on DC and thus the PSU may be used to convert the available AC to the desired DC. In the United States, AC power may be supplied at 110 VAC or 220 VAC. Other regions may use other voltages, however, exemplary embodiments of the present invention may utilize a PSU that is versatile enough to accept a range of input voltages and still provide a constant DC power to the LED clusters. This may allow for the same light fixture to be used in regions with differing power lines and may allow for the occasional voltage fluctuations without adversely affecting the performance and viability of the LED clusters. For example, the PSU may be configured to accept voltages within a range from 85 VAC to 267 VAC while maintaining a constant DC output power.

The heat sink ring 16 may be used to dissipate heat generated from either the LED circuit board 12 or the PSU within the module base 17 such that the LCD circuit board 12 does not cause the PSU to overheat and visa versa. The heat sink ring 16 may be made out of aluminum or an aluminum alloy and may include a series of heat dissipating fins to effectively dissipate heat.

The angular adjustment ring 18 may be rotatable with respect to the module base 17 and fixed with respect to the mounting unit 19. Alternatively, the angular adjustment ring 18 may be rotatable with respect to the mounting ring 19 and fixed with respect to the module base 17. The angular ring 18 may allow the head unit to change rotational orientation with respect to the mounting unit 19 such that when the mounting unit 19 is securely installed into the street light, the LED circuit board 12 may be rotated and the light disbursement emanating therefrom redirected. The angular adjustment ring 18 may also be replaced with an adjustment device that allows for more than one degree of freedom. For example, the adjustment device may allow for both rotation and bending to a desired angle for additional ability to direct the light disbursement.

The mounting unit 19 may include treading for screwing the light fixture into a standard street light fixture. Alternatively, the mounting unit 19 may include another arrangement for mating the light fixture to an appropriate socket. The mounting unit may also include electrical leads for making electrical contact with power lines within the street light socket and these electrical leads may be electrically connected to the PSU. The mounting unit 19 may be rotatable up until a predetermined stopping point when rotated in either direction to facilitate screwing the lighting fixture into and out of the corresponding socket. Alternatively, the mounting unit may be more permanently affixed to the street light pole, for example, by a clamping device.

Figure 2A:
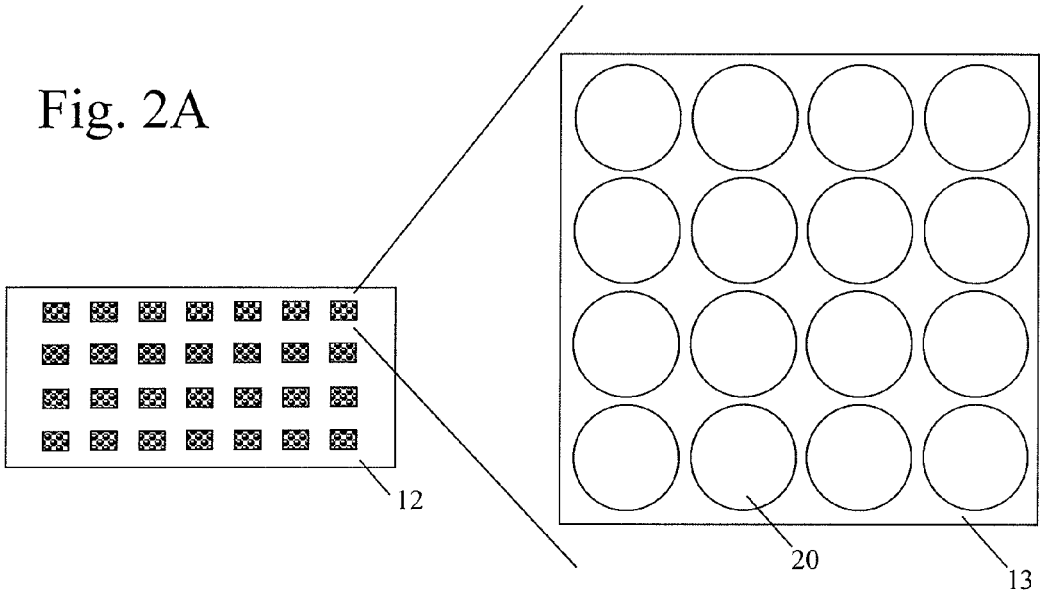
FIGS. 2A and 2B are schematic diagrams for illustrating the design of an LED circuit board 12 according to an exemplary embodiment of the present invention.
Figure 2B:
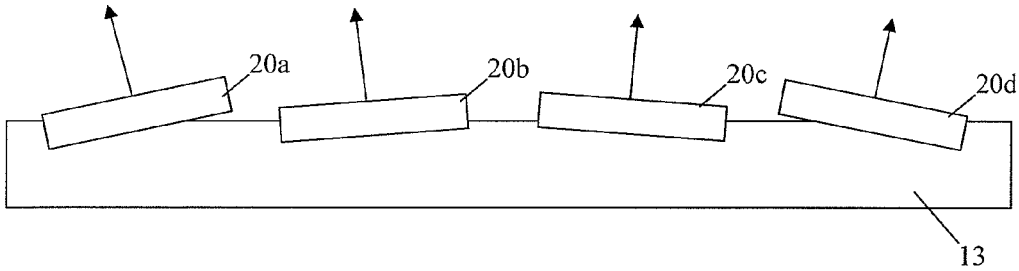

FIGS. 2A and 2B are schematic diagrams for illustrating the design of an LED circuit board 12 according to an exemplary embodiment of the present invention where FIG. 2A illustrates an LED circuit board 12 alongside a close up view of a single LED cluster 13. FIG. 2B illustrates a side view of a single LED cluster 13.

Each LED cluster 13 of the LED circuit board 12 may include a plurality of low power LED units 20. For example, each LED may draw between one and two Watts of power when activated. Each individual LED circuit board 12 may draw from between approximately 25 Watts to approximately 58 Watts. Where white light is produced by combining red, green and blue light, each low power LED unit may include a red LED, a green LED, and a blue LED and may be covered by a diffusive coating for combining the three colors. The LED cluster 13 may be formed by arranging each constituent low power LED unit 20 at a predetermined angle with respect to the plane of the LED cluster 13 so that the desired disbursement pattern of light may be achieved.

As shown in FIG. 2A, the LED units 20 may be arranged in approximately evenly spaced rows and columns, for example, in four rows and four columns forming a cluster 13 of sixteen LED units 20. Other configurations may be used and the LED units 20 may be staggered rather than arranged in rows and columns.

As shown in FIG. 2B, each of the LED units 20 may be oriented in a particular direction so that the cumulative effect of the LED unit 20 is to create a desired disbursement pattern. As shown, a first LED unit 20*a* is pointed at a first direction, a second LED unit 20*b* is pointed at a second direction, a third LED unit 20*c* is pointed at a third direction, and a fourth LED unit 20*d* is pointed at a fourth direction. While FIG. 2B appears to only show orientation of the LED units in a left-to-right direction, the LED units 20 may also be oriented in a front-to-back direction. Accordingly, each LED unit 20 may be oriented to a particular angle. While it is possible for different LED clusters 13 to utilize different LED unit arrangements, all LED clusters may be identical to reduce manufacturing complexity.

Figure 3:
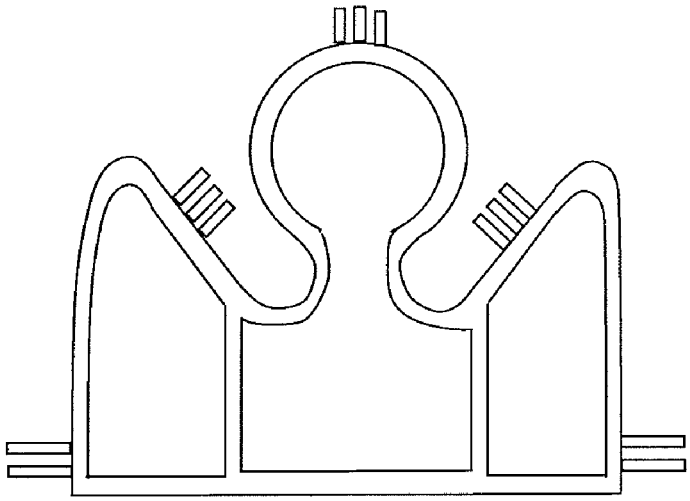
FIG. 3 illustrates a cross section of a heat sink for an LED lighting fixture according to an exemplary embodiment of the present invention.

The heat sink 11 may be formed of aluminum, an aluminum alloy or of another material that is relatively light weight, rigid and a good conductor of heat. The design of the heat sink may be selected to provide effective heat dissipation while minimizing an amount of material used to keep the lighting fixture relatively light weight. FIG. 3 illustrates a cross section of a heat sink for an LED lighting fixture according to an exemplary embodiment of the present invention. According to this exemplary design, the heat sink may be formed as a ribbon of aluminum as if the two-dimensional cross section of FIG. 3 was projected in a direction out of the page. This shape may also be described as a head-and-shoulders pattern or as having multiple petals. This novel heat sink arrangement allows for good thermal contact with the LED circuit board at the bottom of the shape and excellent heat dissipation properties while limiting the outer dimensions of the heat sink such that the combination of the heat sink and the lens form an approximate cylinder of a relatively consistent radius such that when the lighting fixture is screwed into the socket, the projections of the heat sink do not interfere with rotation of the lighting fixture. Additionally, the surface of the aluminum ribbon of the heat sink may include a plurality of protrusions to enhance heat dissipation, for example, as shown.

Figure 4A:
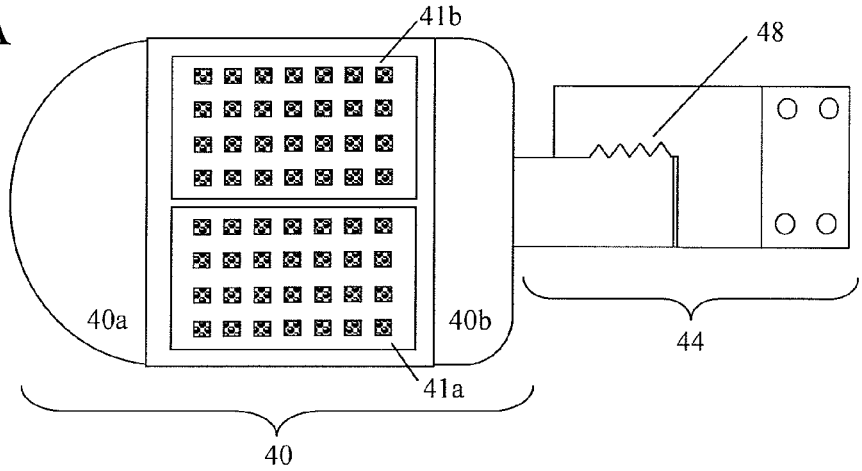
FIGS. 4A-4C are schematic diagrams illustrating an LED based light fixture with multiple LED circuit boards according to an exemplary embodiment of the present invention.
Figure 4B:
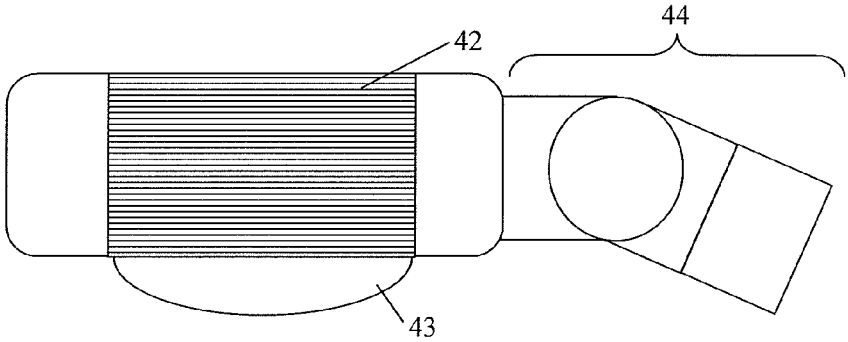
Figure 4C:
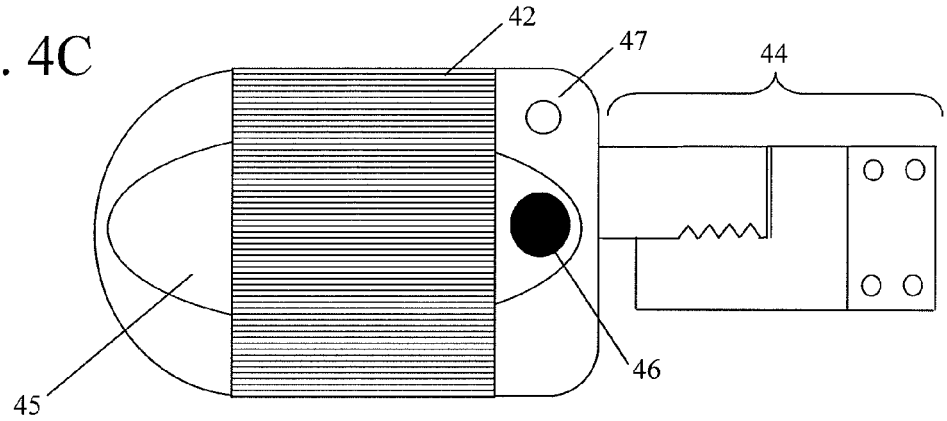

FIGS. 4A-4C are schematic diagrams illustrating an LED based light fixture with multiple LED circuit boards according to an exemplary embodiment of the present invention. Each of FIGS. 4A-4C illustrate the same embodiment rotated to a different angle with FIG. 4A illustrating the lighting fixture with the illuminating elements facing out, FIG. 4B illustrating the lighting fixture with the illuminating elements facing down, and FIG. 4C illustrating the lighting fixture with the illuminating element facing in.

In this embodiment, the lighting fixture may attach directly to a street light pole. The lighting fixture may include a lighting head unit 40 for generating light and a mounting unit 44 for attaching the lighting fixture to the street light pole while allowing for a desired degree of articulation. The lighting head unit may include a heat sink 42 on one side and a lens 43 on the reverse side with one or more LED circuit boards 41*a*, 41*b*, etc. attached therebetween. The LED circuit boards may each include multiple low power LEDs, for example, as described above. However, where two LED circuit boards 41*a* and 41*b* are used, for example, as illustrated, each LED circuit board may draw approximately 58 Watts. The lighting head unit 40 may extend beyond the heat sink 42, for example, as shown, and may include a front extension 40*a* and a back extension 40*b*.

Where there are multiple LED circuit boards 41*a*, 41*b*, etc., the LED circuit boards may be evenly arranged on the underside of the lighting head unit 40. The LED circuit board may be as described above. The heat sink may be formed as a semi-cylinder and may be substantially hollow. The heat sink may also have a plurality of fins on its top side.

The shape of the head unit 40 may be arranged to allow water such as rain and melted snow to easily slide off of the lighting fixture without pooling thereon. Accordingly, the front extension 40*a* and the back extension 40*b* of the head unit 40 may each include a contouring 45 for channeling water off of the lighting fixture. A more detailed example of how the head unit may be contoured is described below with respect to FIG. 6.

The lighting fixture may include a power supply unit (PSU) 46. The PSU 46 may be housed within the lighting head unit 40, either completely, or, for example, socketed into the top of the lighting head unit, for example, the back extension 40*b*, as shown. Socketing the PSU into the head unit may allow for quick removal and reinsertion of the PSU so that the lighting unit may be more easily serviced.

The lighting fixture may also include a light sensor for determining ambient lighting conditions and automatically activating the lighting fixture when the determined amount of ambient light is below a predetermined threshold.

The mounting unit 44 may allow for articulation so that the angle of the head unit 40 may be set to a predetermined level to direct light to the appropriate location. The mounting unit 44 may include a set of interlocking teeth 48 for effectively maintaining the desired angle even when subjected to external pressure such as that caused by a collection of snow, and to maintain the desired angle over a long period of time. The mounting unit 44 may allow for multiple degrees of freedom such that the disbursement of light may be adjusted to fall to a desired location.

Figure 5:
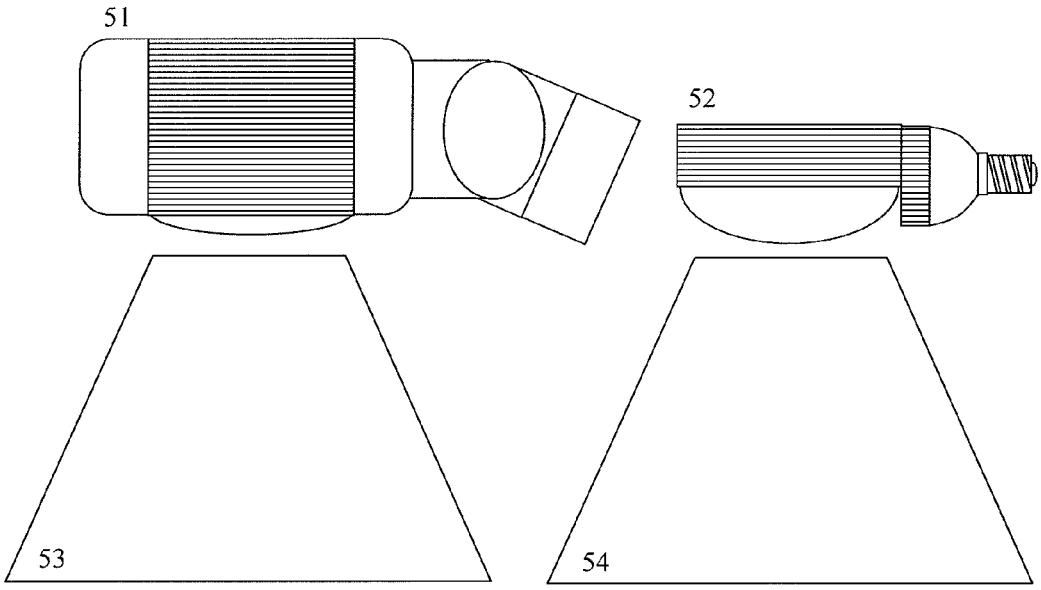
FIG. 5 is a diagram illustrating light disbursement of lighting fixtures according to exemplary embodiments of the present invention.

FIG. 5 is a diagram illustrating light disbursement of lighting fixtures according to exemplary embodiments of the present invention. As can be seen, both examples of lighting fixtures described herein including the fixture described in detail above with respect to FIGS. 4A-4C (51) and the lighting fixture described in detail below with respect to FIGS. 1A-1C (52) may be oriented such that a respective disbursement pattern 53 and 54, respectively, is produced by virtue of both the orientation of the mounting unit 44 or the angular adjustment ring 18 in combination with the orientation of the individual LED units 20 on the LED clusters 13. Accordingly, lighting fixtures according to exemplary embodiments of the present invention may be set up to fully illuminate a desired area while reducing light pollution and the inefficiencies associated with omnidirectional light.

Figure 6A:
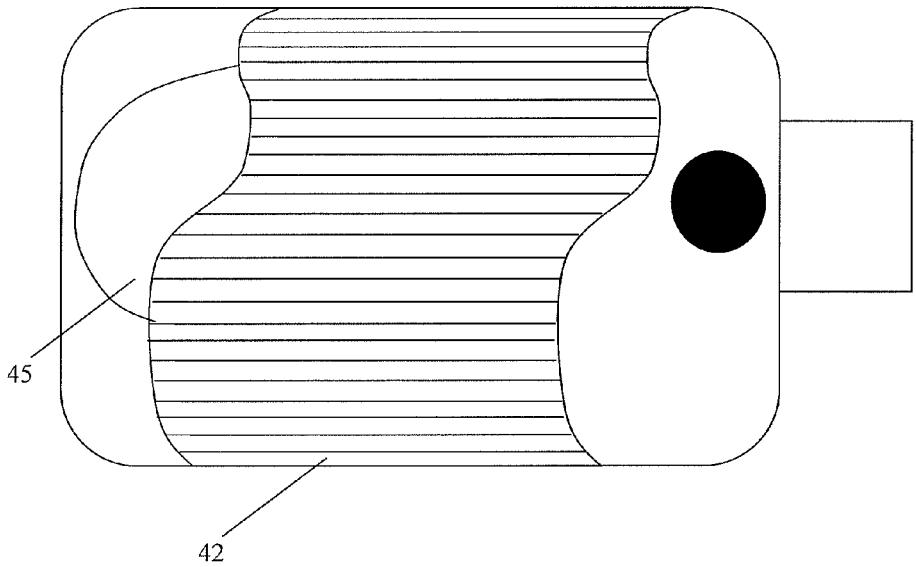
FIGS. 6A and 6B are schematic diagrams illustrating contouring of a lighting fixture head unit according to an exemplary embodiment of the present invention.
Figure 6B:
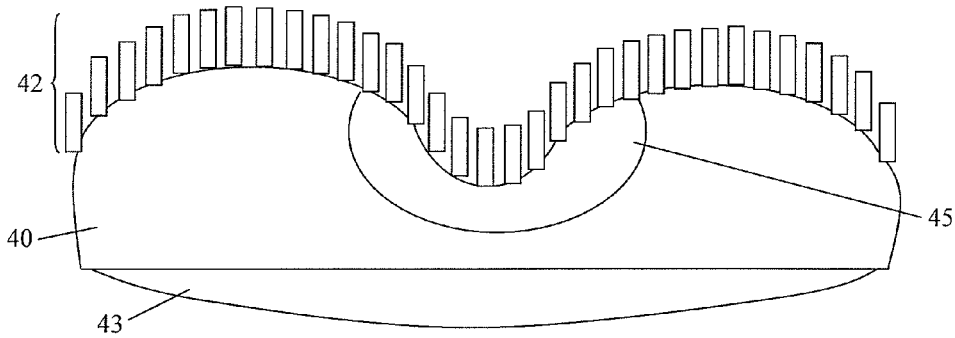

FIGS. 6A and 6B are schematic diagrams illustrating contouring of a lighting fixture head unit according to an exemplary embodiment of the present invention. FIG. 6A is a perspective view showing a lighting fixture with a contoured heat sink 42. FIG. 6B is a front-facing view of the same lighting fixture. In this figure, the head unit 40 is oriented with the lens 43 facing down, the heat sink 42 facing up, and the mounting unit 44 hidden behind. As can be seen, the contouring 45 of the head unit allows for water to be channeled off of the lighting fixture while the heat sink 42 is also contoured in a wave shape with two peaks and a nadir therebetween. The nadir of the heat sink 42 directs water from the heat sink 42 towards the sides of the head unit where it can easily flow off from the contour 45 of the head unit.

Alternatively, the heat sink and/or the head unit may be contoured in another manner that permits water to easily flow off of the top of the head unit without forming puddles. By permitting water to flow off of the top of the head unit, corrosion may be lessened and the chances of water leaking into the lighting fixture interior may be reduced. Appropriate contouring may thereby alleviate the tendency for water to pool between the protrusions of the heat sink and accordingly, by balancing the design of the heat sink with the contours of the head unit, LED based lighting fixtures according to exemplary embodiments of the present invention may be able to effectively dissipate heat generated by the LED circuit boards while preventing the accumulation of water.

Exemplary embodiments described herein are illustrative, and many variations can be introduced without departing from the spirit of the disclosure or from the scope of the appended claims. For example, elements and/or features of different exemplary embodiments may be combined with each other and/or substituted for each other within the scope of this disclosure and appended claims.

What is claimed is:

1. An LED based lighting fixture for street lighting, comprising:

a lighting head unit including, on a top side thereof, a heat sink structure for dissipating heat and, below the heat sink structure, a flat LED circuit board comprising a plurality of low power LEDs oriented on the LED circuit board in a plurality of different angles with respect to the LED circuit board such that light emitted from the lighting head unit is cast in a desired pattern of disbursement;

a lens unit attached to the bottom side of the lighting head unit covering the LED circuit board; and a mounting unit for mounting the lighting head unit to a fixed structure, the mounting unit being adjustably connected to the lighting head unit such that an angle of the lighting head unit, relative to the fixed structure, is adjustable to direct pattern of disbursement of light cast from the lighting head unit to a desired direction.

2. The lighting fixture of claim 1, wherein the heat sink structure comprises an aluminum ribbon with a series of projections extending tangentially therefrom, wherein the aluminum ribbon comprises aluminum or an alloy thereof.

3. The lighting fixture of claim 2, wherein the aluminum ribbon has head-and-shoulders shaped cross section or a plurality of petal extensions.

4. The lighting fixture of claim 1, wherein the LED circuit board is ceramic and conducts heat from the plurality of low power LEDs to the heat sink structure.

5. The lighting fixture of claim 1, wherein the plurality of low power LEDs are organized as a plurality of identical clusters wherein each cluster comprises LEDs oriented in a plurality of different directions relative to the orientation of the lighting head.

6. The lighting fixture of claim 5, wherein the identical clusters are arranged in rows and columns and are spaced equally from one another.

7. The lighting fixture of claim 6, wherein the identical clusters are arranged as seven columns and four rows, with the rows run along a longest axis of the lighting fixture, wherein each identical cluster comprises sixteen low power LEDs oriented in a plurality of different directions relative to the orientation of the lighting head unit.

8. The lighting fixture of claim 1, wherein the plurality of low power LEDs together draw from between 25 Watts and 60 Watts maximum power.

9. The lighting fixture of claim 1, wherein the lens unit comprises a single convex covering that covers the entire LED circuit board and attaches directly to the lighting head unit such that the LED circuit board is hermetically sealed and impervious to moisture.

10. The lighting fixture of claim 1, further comprising a module base that is attached at one end to the lighting head unit and at another end to the mounting unit, the module base unit housing a power supply unit for supplying power to the LED circuit board, the power supply unit being configured to accept a range of input voltages from 85 Volts to 267 Volts while providing a constant output voltage to the LED circuit board.

11. The lighting fixture of claim 10, wherein the heat sink structure and the lens unit together form an approximate cylinder with a fixed radius and a radius of the module base is less than the fixed radius of the heat sink structure together with the lens unit.

12. The lighting fixture of claim 1, further comprising a thermal conductive paste between the LED circuit board and the heat sink structure.

13. An LED based lighting fixture for street lighting, comprising:

a lighting head unit including, on a top side, a heat sink structure for dissipating heat and, on a bottom side, a plurality of flat LED circuit boards, each board comprising a plurality of low power LEDs oriented on the LED circuit board in a plurality of different angles with respect to a respective LED circuit board of the plurality of LED circuit boards such that light emitted from the lighting head unit is cast in a desired pattern of disbursement;

a lens unit attached to the bottom side of the lighting head unit covering the plurality of LED circuit boards; and a mounting unit for mounting the lighting head unit to a fixed structure, the mounting unit being adjustably connected to the lighting head unit such that an angle of the lighting head unit, relative to the fixed structure, is adjustable to direct pattern of disbursement of light cast from the lighting head unit to a desired direction.

14. The lighting fixture of claim 13, wherein the top side of the head unit and the heat sink structure attached thereto are contoured to prevent the collection of rain water.

15. The light fixture of claim 14, wherein the contour of the heat sink structure forms a wave shape with two peaks and a nadir therebetween, the nadir of the heat sink contour opening into a depression within the top side of the head unit for channeling water off of the light fixture.

16. The lighting fixture of claim 13, wherein the heat sink structure includes a plurality of fins for effectively dissipating heat.

17. The lighting fixture of claim 13, wherein the lighting head unit comprises aluminum for effectively conducting heat from the plurality of LED circuit boards to the heat sink structure.

18. The lighting fixture of claim 13, wherein a light sensing unit for sensing ambient light is attached to the top side of the lighting head unit for activating the LED circuit boards when the detected ambient light is below a predetermined threshold and deactivating the LED circuit boards when the detected ambient light is above a predetermined threshold.

19. The lighting fixture of claim 13, wherein the mounting unit includes a set of interlocking teeth for maintaining the desired angle of the lighting head unit relative to the fixed structure even when significant pressure is applied to the lighting head unit.

20. The lighting fixture of claim 13, wherein a power supply unit for supplying power to the plurality of LED circuit boards is contained within the lighting head unit.

21. The lighting fixture of claim 13, wherein the mounting unit includes a remote-controlled actuator for remotely adjusting the desired angle of the lighting head unit relative to the fixed structure.

22. The lighting fixture of claim 13, wherein the plurality of LED boards comprises two LED boards.

23. The lighting fixture of claim 22, wherein the plurality of LED boards comprises 4, 6 or 8 LED boards.

24. The lighting fixture of claim 13, wherein the desired pattern of disbursement of light of the lighting head unit is shaped to illuminate a particular area while minimizing light directed to surrounding areas.

25. The lighting fixture of claim 24, wherein the particular area includes one or more lanes of a roadway.

26. The lighting fixture of claim 13, wherein the lens unit is attached to the bottom side of the lighting head unit with a piano hinge on one side and one or more non -removable thumb screws on another side such that the lens unit is easily opened and closed without risking the loss of the screws.

* * * * *